United States Patent [19]

Todd

[11] 4,446,917

[45] May 8, 1984

[54] METHOD AND APPARATUS FOR PRODUCING VISCOUS OR WAXY CRUDE OILS

[76] Inventor: John C. Todd, 10646 Marguis, Dallas, Tex. 75229

[21] Appl. No.: 19,579

[22] Filed: Mar. 12, 1979

Related U.S. Application Data

[63] Continuation-in-part of Ser. No. 948,434, Oct. 4, 1978.

[51] Int. Cl.[3] ..... E21B 36/02

[52] U.S. Cl. ..... 166/59; 166/61; 122/4 D

[58] Field of Search ..... 166/57, 58, 59, 60, 166/61, 62; 122/4 D

[56] References Cited

U.S. PATENT DOCUMENTS

| | | | |
|---|---|---|---|
| 2,421,528 | 6/1947 | Steffen | 166/61 |
| 2,444,754 | 7/1948 | Steffen | 166/62 |
| 2,644,531 | 7/1953 | McLean | 166/61 X |
| 2,647,585 | 8/1953 | Roberts | 166/61 |
| 2,705,535 | 4/1955 | Wateman | 166/61 X |
| 2,778,610 | 1/1957 | Bruegger | 122/4 D |
| 2,856,905 | 10/1958 | Bowen | 122/4 D |
| 3,107,728 | 10/1963 | Kehn | 166/59 |
| 3,113,623 | 12/1963 | Krueger | 166/59 |
| 3,376,932 | 4/1968 | Hunt | 166/59 |
| 3,420,300 | 1/1969 | Todd | 166/59 X |
| 3,713,482 | 1/1973 | Lichte, Jr. et al. | 166/59 |

*Primary Examiner*—James A. Leppink

*Attorney, Agent, or Firm*—Hubbard, Thurman, Turner & Tucker

[57] ABSTRACT

Tubing which contains crude oil being moved to the surface is surrounded by concentric sections of pipe at various depths along portions of the tubing. Said concentric sections of pipe contain a porous media incorporating an oxidizing catalyst in the annulus between said pipe and the tubing. A fuel and oxygen containing gas is passed down the tubing/casing annulus and passes through the catalyst bed causing the fuel to burn. The exhaust gas may be passed to the surface or it may enter the crude containing tubing to assist in gas lifting the crude to the surface. The crude is heated by the heated sections surrounding the tubing and by the hot exhaust gases thus reducing the crude viscosity and preventing the building up of wax within the tubing. The catalyst bed may alternatively comprise a single layer of catalyst supporting particles attached to the outer surface of the production tubing string or selected sections thereof.

4 Claims, 3 Drawing Figures

METHOD AND APPARATUS FOR PRODUCING VISCOUS OR WAXY CRUDE OILS

BACKGROUND OF THE INVENTION

This is a continuation in part of a application, Ser. No. 948,434 filed Oct. 4, 1978, now abandoned.

This invention relates to the downhole heating of crude oils in a well bore to reduce oil viscosity and prevent precipitation of wax to assist in lifting these oils to the surface.

A reference believed to be relevant to the present invention is U.S. Pat. No. 3,420,300 issued to the present Applicant on Jan. 7, 1969. This patent teaches the use of a catalytic heater in a borehole for generating hot gas to heat subsurface formations.

Viscous or waxy crude oils found at several hundreds or thousands of feet below the surface are often difficult to pump to the surface due to their high viscosity or to the precipitation of certain fractions of the oil as wax. The oil may be so viscous as to require dilution downhole with a less viscous oil such as kerosene at considerable expense. Waxy crudes may or may not be excessively viscous but due to changes in temperature and evolution of gases the wax may precipitate in the tubing string. Said buildup of wax can eventually decrease the flow to an uneconomic rate. Mechanical methods, such as scraping and solvents have been used to remove the wax from the tubing at considerable expense and labor. It is known that the application of heat will greatly reduce the viscosity of crude and also wax may be prevented from precipitating by heating. Various means are used to pump the oil to the surface such as rod pumps, plunger pumps, downhole centrifugal pumps, gas lifting, etc., as well as flowing by the natural pressure found in the hydrocarbon bearing formation. In general, regardless of the method of pumping, the crude oil flows through tubing to the surface. All the pumping methods are inefficient when the crude is viscous or if the tubing string is plugged with wax or asphaltic materials.

SUMMARY OF THE INVENTION

An object of this invention is to provide a method and apparatus for producing viscous and waxy crude oils by the application of heat either continuously or intermittently as needed to efficiently move the oil to the surface.

In a first embodiment of this invention a tubing string through which difficult to produce crudes are produced is fitted with a system of gas lift valves similar to a normal gas lift operation. However, the lift gas is a fuel-oxygen containing gas which passes through the gas lift valve into a section of pipe concentric with the tubing string containing crude oil. Such concentric pipe is larger than the tubing and the annulus between these two pipe contains a porous media incorporating an oxidizing catalyst or catalysts. The fuel-oxygen containing gas passes through the porous bed and burns producing heat which is conducted through the tubing wall to the crude oil. Also the heated exhaust gas moves into the crude containing tubing to heat the crude and provide a gas lift to move the oil to the surface. Several such heating sections are positioned at depths along the length of the tubing string to give a hot gas lift to the crude oil. The number of gas lift valves with porous media heating sections required will depend on the oil viscosity and depth as well as other factors common to gas lifting. The hot gas lifting may augment the other means of lifting crude oil such as rod pumping thus improving the overall efficiency of such means of lifting the crude oil.

A second embodiment of this invention consists of a larger concentric tube which surrounds the production tubing such as to create an annulus which is filled with a porous media containing an oxidizing catalyst. This outer tube may extend from the surface to such a depth as to exceed the depth where wax deposition occurs to any extent. This depth may be a few hundred or in some cases, a few thousand feet. The catalyst is retained in the annulus by a porous plate to permit passage of gases. A fuel-oxygen containing gas is forced down the annulus between the porous media containing pipe and the larger well bore casing string which retains the various formations penetrated. This fuel-oxygen gas passes through the porous plate into the porous media containing the catalyst where it burns to produce heat which is transferred to the tubing string and crude oil to prevent the deposition of wax and asphalt and to reduce the viscosity of the crude oil. If the buildup of wax is not severe the burning and heating of the tubing may be intermitted over a several day period or perhaps a few weeks. The intermittent heating would be easily automated to require no labor to remove the wax.

A third embodiment of this invention consists of one or more lengths of production tubing having at least one layer of catalyst supporting particles supported on the surface thereof. These sections of tubing comprise all or portions of the production tubing string from the surface down to the depth where wax deposition may occur. A fuel oxygen containing gas is supplied to the catalyst layer by pumping through the annulus between the tubing string and the well casing. Exhaust gases are then vented either through gas lift valves or by periodically pumping gas from the annulus.

The process media bed may be for example sand, glass beads or alumina but not limited to these materials as many particulate materials would be suitable. The oxidation promoting catalyst may be one of a number well known in the process industries which generally contain metals, for example, platinum, palladium, vanadium, iron, titanium, copper, chromium, cobalt, aluminum, nickel, manganese, cerium, silicon, silver, molybedenum, tin, tungsten, etc. have been used separately or in combination supported on various substrates. The catalyst may not necessarily be required throughout the entire bed as once the bed is sufficiently heated the fuel will be burned without the catalyst. If the bed temperature is operated below the ignition temperatures of the fuel-oxygen gas used the catalyst will be required. The use of the catalyst does not preclude starting the burning by other means as by electrical heater or by chemical heating.

The fuel-oxygen gas may contain one of the light hydrocarbons such as methane, ethane, propane, etc., or carbon monoxide may be used as found in flue gases. The heat content of the fuel may be quite low, for example about one percent methane would give about 10 BTU/scf which would burn with air to produce temperatures of about 500 degrees F. The fuel may be the predominant gas with the oxygen limited to prevent overheating. For example to methane may be added about 9.5% air to create a burning temperature of about 500 degrees F. Liquid fuels may be used for example by atomization with air. Solid fuels may also be used usually with an initial heating with a gaseous fuel. Solid fuels incorporated into the porous bed however, would ordinarily require replacement after a period of time.

BRIEF DESCRIPTION OF THE DRAWINGS

This invention will now be described more particularly with reference to the accompanying drawing wherein.

DESCRIPTION OF THE PREFERRED EMBODIMENTS

Figure 1:
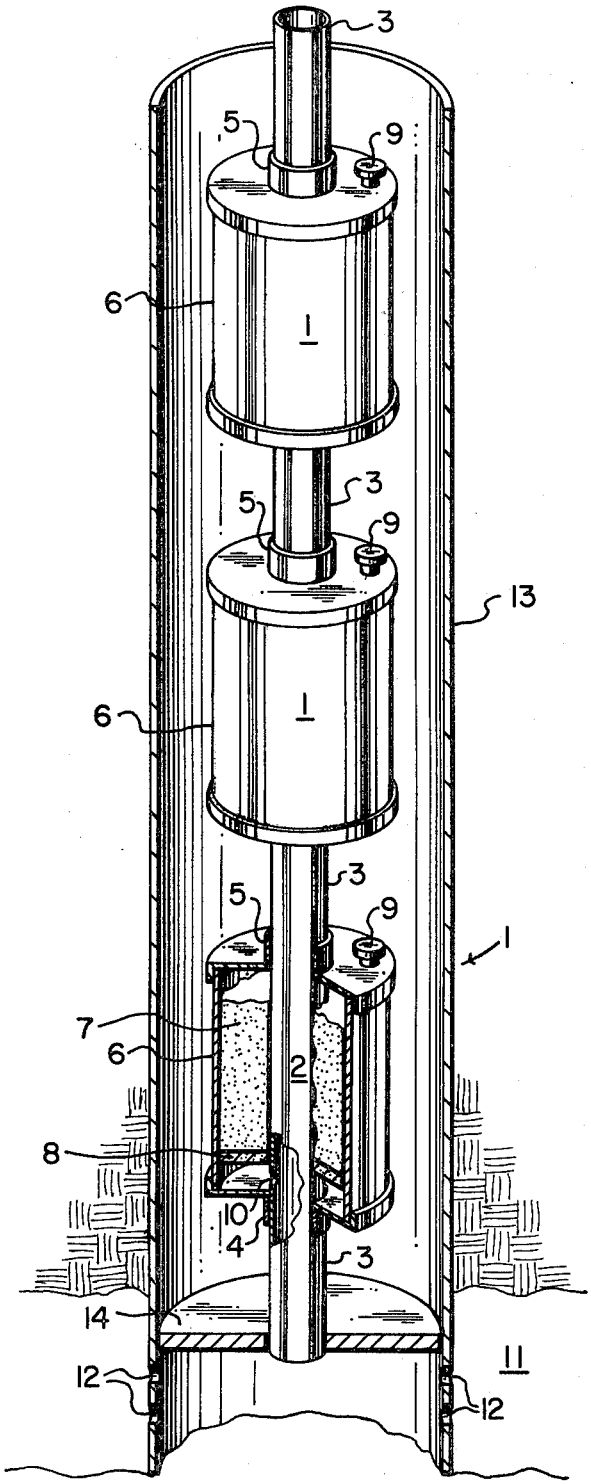
FIG. 1, FIG. 2 and FIG. 3 are sectional views of three embodiments of the apparatus for producing viscous and waxy crude oil.

Referring to FIG. 1, downhole heaters, generally designated 1, comprise an elongated member of two concentric pipes. An inner pipe 2 is essentially the same size as a production tubing string 3 and is fitted to the tubing string 3 at the lower end by collar 4 and at the upper end by collar 5 which collars also retain an outer pipe 6. Within the annulus of pipe 6 and pipe 2 is a porous media 7 containing oxidation catalyst which is retained at the bottom by a porous plate 8. Upper collar 5 is fitted with a gas lift valve 9, which permits combustion fuel-oxygen gas to enter the porous media 7 where it burns to produce heat which is transferred by conduction through the pipe 2 wall to heat the crude oil therein reducing its viscosity. The exhaust gas from the burning passes through the porous disc plate 8 and through ports 10 in the lower collar 4 into the crude oil in string 3 lifting it to the surface as it expands to a lower pressure.

In use a production tubing string 3 with a preselected and spaced number of heaters 1 is run into a wellbore which passes through a hydrocarbon producing zone 11. The wellbore is typically cased with a casing string 13 having perforations 12 at the producing zone to allow crude oil to enter the wellbore. The bottom of production string 3 is positioned at the top of producing zone 11 and a packer 14 is expanded to seal the annulus between the tubing 3 and casing 13. When thus positioned and sealed, oil produced from formation 11 moves into string 3 to be lifted to the surface. A gas containing fuel and oxygen is then pumped into the annulus between string 3 and casing 13 at the earth's surface and is conducted by the annulus to the heaters 1. The gas enters the heaters through valves 9 and flows through porous media 7 where combustion occurs. The products of combustion pass through plate 8 and ports 10 into production string 3 to provide further heating and gas lift. Much of the heat of combustion is transferred by conduction through pipe 2 to the produced crude oil.

Figure 2:
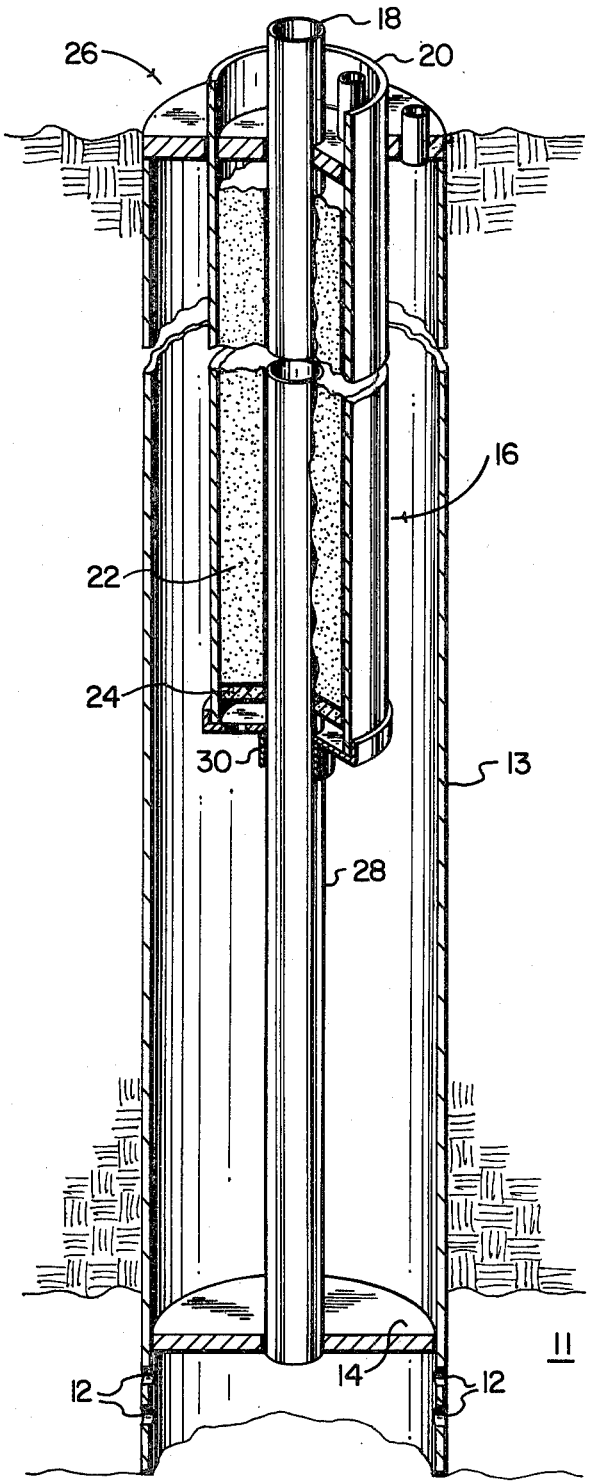

A second embodiment of the present invention is illustrated in FIG. 2, where a heater is designated at 16. This heater comprises concentric pipes 18 and 20 and a catalyst bed 22 contained in the annulus between pipes 18 and 20. This annulus is closed at its bottom by a porous plug 24 which provides support for bed 22. Pipes 18 and 20 are typically made of high temperature steel and are supported at the top by a well head 26. The lower end of pipe 18 is adapted for connection to a production tubing string 28 by means of a collar 30.

As with the first embodiment, this second embodiment is positioned within a wellbore having a casing 13 which has performations 12 opposite an oil producing zone 11. The bottom of production tubing string 28 is positioned at the top of zone 11 and is equipped with a packer 14 which is expanded to seal the annulus between tubing 28 and casing 13. The well head 26 provides surface access to both the annulus between pipes 18 and 20 and the annulus between pipe 20 and casing 13. As oil from zone 11 is produced up string 28 it begins to cool. The length of heater 16 is selected so that its lower end is at least as deep as the point where cooling of the produced crude would cause excessive viscosity increase or solids deposition. A combustion gas containing both fuel gas and oxygen is pumped into the annulus between pipe 20 and casing 13 and flows to the lower end of heater 16. The gas then passes through porous plug 24 into catalyst bed 22 where combustion occurs generating heat which is conducted through pipe 18 to the produced crude. The products of combustion pass out of the top of the catalyst bed 22 and can be vented through wellhead 26. As noted above the heating may be continuous or only intermittent as desired and the quantity of heat may be adjusted by varying the combustion gas content and flow rate.

Figure 3:
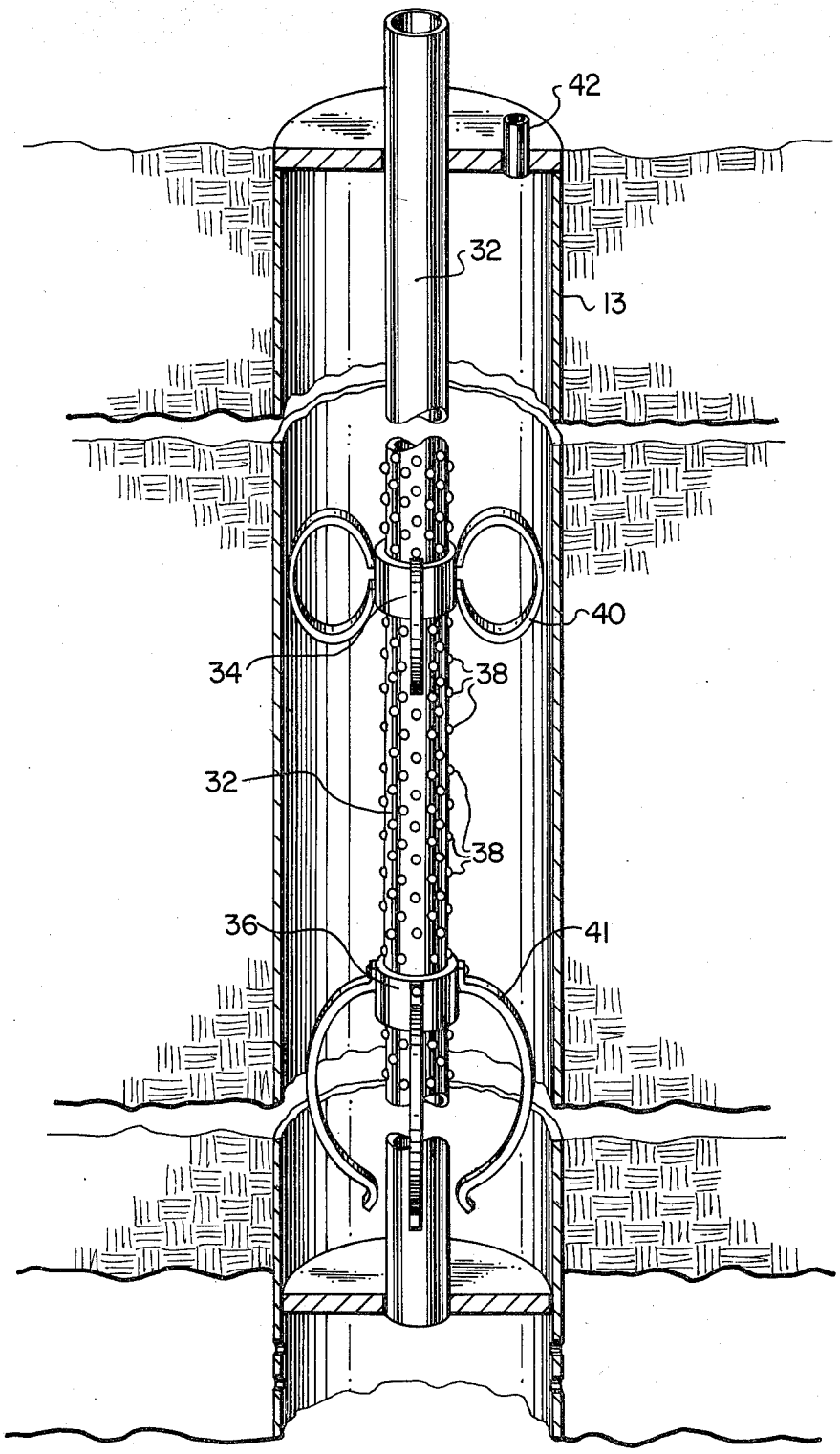

A third embodiment of the present invention is illustrated in FIG. 3 where a catalyst bed is shown distributed over a substantial portion of the outer surface of a production tubing string. In FIG. 3 at least one section 32 of tubing between collars 34 and 36 carries a layer of catalyst supporting particles 38 on its outer surface. Since the catalyst bed in this embodiment is distributed over a relatively large surface area, it may operate at a relatively low temperature and therefore the tubing section 32 may be a standard tubing section to which the catalyst particles have been attached. As a result the assembly of this tubing string would be essentially the same as any other tubing string. Collars 34 and 36 may include gas lift valves or check valves through which the products of combustion may be exhausted. It is preferable that at least one of the gas lift valves be positioned below the lowest tubing section 32 carrying catalyst supporting particles. The collars 34 and 36 or portions of the tubing string may be equipped with centralizers 40 and 41 to prevent contact of the catalyst particles 38 with the inner surface of casing 13 on running of the tubing string into the well bore. Centralizers 40 and 41 are preferrably spring steel straps riveted or welded to collars 34 and 36. Centralizer 40 forms a complete loop with both ends of the strap welded to collar 34. Centralizer 41 on the other hand is preformed into a desired shape and has an upper end welded to collar 36 and a lower end which is free. Other shapes and methods of attachment may be employed if desired.

As noted above, the catalyst may be supported on particles 38 such as silica, glass beads, alumina pellets, ceramic particles or other particles known to be useful for supporting oxidizing catalysts. For clarity, FIG. 3 illustrates the particles 38 as fairly large pellets which would preferably be alumina pellets which are of high strength and can be provided with fairly porous surfaces to maximize the catalyzing surface area. The catalyst supporting particles 38 may be bonded to the surface of tubing section 32 in a number of ways. By proper surface treatment of tubing 32, a fairly low temperature glass glaze may be used to bond alumina catalyst particles to the steel pipe. Glass beads or silica particles supporting catalyst could be bonded in the same way. Alternatively various synthetic adhesives capable of withstanding fairly high temperatures may be employed. Various silicone rubbers, epoxies and teflon materials may be used for this purpose. The synthetic materials may preferred since heat treatment of the tubing string 32 would not necessarily be required, and the materials would be more flexible than a glaze and could better withstand rough treatment. As yet another alternative metallic materials may be employed to bond the catalyst particles 38 to the tubing section 32. This may be accomplished by dipping or spraying a metal layer on the pipe surface and partly embedding catalyst particles 38 into the metal layer while it is molten.

As an alternative to the use of discrete catalyst particles 38, more continuous forms of support may be employed. For example, a catalyst may be precipitated directly onto the surface of tubing section 32. A second alternative is the use of a continuous band or tape of glass fibers or asbestos cloth embedded with catalyst particles which may be wrapped around the tubing section 32 and attached by one of the above described synthetic adhesives or mechanically bound with straps or similar supports.

Since the catalyst particles 38 are individually bonded to the surface of pipe 32 the heat of combustion generated by the catalyst particle is quickly and efficiently coupled to the tubing and thereby to the crude oil within the tubing so that the catalyst may operate at a relatively low temperature. The temperature attained would be controlled by the fuel and oxygen supplied. In some applications the heat thus supplied will be sufficient to avoid the need for surface heaters for the produced oil.

In the FIG. 3 embodiment the annulus between casing 13 and the tubing 32 provides a conduit for directing a gas containing fuel and oxygen to the catalyst on the particles 38. An inlet 42 is provided to this annulus at the earth's surface for supplying the gas. If gas lift valves are provided, for example in collars 34 and 36, the products of combustion will be swept through these valves into the produced crude and thereby exhausted through the tubing string 32. In some cases the FIG. 3 embodiment may be operated without employing gas lift valves. Heating of the production tube is often required only in the upper portions of the wellbore. As a result, if a fuel-oxygen gas is pumped through inlet 42, combustion will occur as it passes down the wellbore and contacts the catalyst particles 38. By steadily increasing the pressure in the annulus, a considerable amount of gas may be pumped in and stored in the lower portions of the annulus. The process may then be periodically reversed by releasing the pressure from the annulus and pumping the exhaust gases out. While essentially no heating would occur during the venting of exhaust gases, this could be done in a relatively short time if required. Quite often, the heating treatments are only needed intermittently so this alternative means of operation would be quite appropriate.

While the present invention has been shown and illustrated in terms of specific apparatus it is apparent that various modifications can be made within the scope of the present invention as defined by the appended claims.

I CLAIM:

1. Apparatus for heating crude oil within production tubing in a wellbore comprising:

a first conduit adapted for connection at both ends to said production tubing to provide a continuous flow path for crude oil through said tubing and first conduit, a second conduit larger than said first conduit, spaced concentrically about said first conduit, upper and lower collars connecting said first and second conduits together, a porous plug closing the bottom of the annulus between said first and second conduits, a catalyst bed positioned in the annulus between said first and second conduits above said porous plug, a gas lift valve carried by said upper collar for conducting a combustion gas containing both a fuel and oxygen to said catalyst bed, and port means for providing communication between said annulus below said porous plug and the interior of said first conduit, whereby products of combustion from said catalyst bed are conducted into the first conduit.

2. Apparatus for heating crude oil within production tubing in a wellbore comprising:

a first conduit adapted for connection at at least one end to said production tubing to provide a continuous flow path for crude oil through said tubing and first conduit, a second conduit larger than said first conduit, spaced concentrically about said first conduit, a porous plug closing the bottom of the annulus between said first and second conduits, a catalyst bed positioned in the annulus between said first and second conduits, means for passing a combustion gas containing both a fuel and oxygen through said catalyst bed, a wellhead supporting said first and second conduits at their upper ends, and a well casing surrounding said second conduit and supporting said well head, said well head having first and second ports providing access to the annulus between said first and second conduits and the annulus between said second conduit and casing respectively, said second port and annulus between said second conduit and casing providing means for passing combustion gas through said catalyst bed.

3. Apparatus for heating crude oil within production tubing in a wellbore comprising:

a first conduit forming at least a portion of said production tubing, at least a first layer of catalyst supporting particles positioned adjacent and in thermal contact with the outer surface of said first conduit, a second conduit surrounding said first conduit, a porous plug closing the bottom of the annulus between said first and second conduits and supporting said catalyst supporting particles, upper and lower collars connecting said first and second conduits together, a gas lift valve carried in said upper collar for conducting combustion gas to said catalyst bed, and port means for providing communication between said annulus below said porous plug and the interior of said first conduit, whereby products of combustion from said catalyst supporting particles are conducted into the first conduit.

4. Apparatus for heating crude oil within production tubing in a wellbore comprising:

a first conduit forming at least a portion of said produciton tubing, at least a first layer of catalyst supporting particles positioned adjacent and in thermal contact with the outer surface of said first conduit, a second conduit surrounding said first conduit, a porous plug closing the bottom of the annulus between said first and second conduits and supporting said catalyst supporting particles, a wellhead supporting said first and second conduits at their upper ends, and a well casing surrounding said second conduit and supporting said wellhead, said wellhead having first and second ports providing access to the annulus between said first and second conduits and the annulus between said conduit and casing respectively, said second port and annulus between said second conduit and casing providing means for passing combustion gas through said catalyst bed.

* * * * *